US006393988B1

(12) United States Patent
Gaskin

(10) Patent No.: US 6,393,988 B1
(45) Date of Patent: May 28, 2002

(54) PROCESS FOR TRANSFER PRINTING ON FLAT ARTICLES

(75) Inventor: John Graham Gaskin, Cardiff (GB)

(73) Assignee: Max Imaging Systems Limited, Cardiff (GB)

( * ) Notice: Subject to any disclaimer, the term of this patent is extended or adjusted under 35 U.S.C. 154(b) by 0 days.

(21) Appl. No.: 09/509,955

(22) PCT Filed: Jul. 30, 1999

(86) PCT No.: PCT/GB99/02511

§ 371 (c)(1),
(2), (4) Date: Mar. 31, 2000

(87) PCT Pub. No.: WO00/07822

PCT Pub. Date: Feb. 17, 2000

(30) Foreign Application Priority Data

Aug. 1, 1998 (GB) ..... 9816816

(51) Int. Cl.[7] ..... B41F 1/54
(52) U.S. Cl. ..... 101/484; 101/32; 101/34
(58) Field of Search ..... 101/484, 492, 101/493, 32, 125, 126, 127, 128, 129, 211, DIG. 30, 33, 34, 35

(56) References Cited

U.S. PATENT DOCUMENTS 4,573,677 A 3/1986 Cuir et al. ..... 271/236
5,031,525 A * 7/1991 Kent et al. ..... 101/32

FOREIGN PATENT DOCUMENTS

| | | | |
|---|---|---|---|
| DE | 29514627 U1 | | 1/1996 |
| GB | 1 5 30262 | | 10/1978 |
| GB | 2 120 168 A | | 11/1983 |
| GB | 2358371 A | * | 7/2001 |

* cited by examiner

*Primary Examiner*—Andrew H. Hirshfeld
*Assistant Examiner*—Minh H. Chau
(74) *Attorney, Agent, or Firm*—David P Gordon; David S Jacobson; Thomas A Gallagher

(57) ABSTRACT

A method of producing a registrable visible image on two or substantially flat articles includes providing substantially flat articles of predetermined shape having at least two edges, providing a sublimation transfer carrier sheet having a predetermined mirror image on an area of said carrier sheet, providing edge templates adjacent the area, each of the edge templates being arranged to abut a corresponding edge of the predetermined shape, placing one of the articles and a sublimation transfer carrier sheet on a a support surface and arranging the area of the carrier sheet such that the mirror substantially covers the predetermined shape with each of the two edges abutting a respective one of the edge templates, allowing sublimation transfer of the image, removing the carrier sheet and the edge templates so as to leave a predetermined visible image within the shape, and repeating the steps with at least one more article which can be arranged in register with the first article.

18 Claims, 2 Drawing Sheets

PROCESS FOR TRANSFER PRINTING ON FLAT ARTICLES

BACKGROUND OF THE INVENTION

1. Field of the Invention

The present invention is concerned with a printing process, and in particular a process of producing a transfer printed image on a flat article of predetermined shape, such as a floor or wall covering or the like.

2. State of the Art

Flat articles of predetermined shape (preferably space-filling or tessellating shapes) include tiles or the like. One important category of such articles includes textile articles, especially textile articles of the nature of floor coverings (carpets, rugs or the like). Such textile articles typically comprise a backing with fibres woven or tufted therein.

When it is desired to produce indicia or patterns in such textile articles, fibres of contrasting colour are generally woven or tufted into the backing. While this enables quite effective designs such as words or logos to be produced in the textile article, the range of colours is limited, and it has not been possible to produce complex, multicolour pictorial designs. Attempts to produce a colour print on textile substrates by a transfer process have had only limited success, as the colour print has been relatively impermanent, and it has been difficult to cover large areas in this way.

This problem of covering large areas is particularly severe when attempts have been made to apply a complex print to adjacent tiles or other space-filling shapes, as it has been found to be difficult or impossible to keep the print in register with the substrate.

SUMMARY OF THE INVENTION

It is therefore an aim of the present invention to provide a method of producing a visible image on a flat article, which alleviates the problems outlined above.

Therefore, according to the present invention, there is provided a method of producing a visible image on a substantially flat article, which method includes:

(a) providing a substantially flat article having at least one major face of substantially uniform pale colour and of predetermined shape, the shape having at least two edges each of which edges defines a respective step when the article is laid on a support surface;

(b) providing a sublimation transfer carrier sheet having a predetermined mirror image on an area of the carrier sheet, such that the mirror image is adapted to substantially cover the predetermined shape;

(c) providing edge templates adjacent the area, each of the edge templates being arranged to abut a corresponding edge of the predetermined shape;

(d) placing the article on the support surface and arranging the area of the carrier sheet in contact with the major face such that the mirror image substantially covers the predetermined shape with each of the two edges abutting a respective one of the edge templates;

(e) allowing sublimation transfer of the image from the carrier sheet to the face; and (f) removing the carrier sheet and the edge templates from the face so as to leave a predetermined visible image on the face within the shape.

The method according to the invention may be carried out twice(or more)in succession on a plurality of such articles; in this embodiment, the successive sublimation transfer carrier sheets may provide successive parts of a larger picture. By ensuring that the successive parts are in register according to the invention, a larger, space-filling picture can be produced, with the image extending continuously across a plurality of such articles when placed edge-to-edge.

It is particularly preferred in this embodiment that the shapes defined by the major face should be space-filling shapes. It is especially preferred that the shapes should be tessellating; that is, they should have straight edges and be rectangular (including square), triangular, or hexagonal, such that an array of the articles can fill a space without leaving gaps between the articles.

It is preferred that the article is a textile, for example, of the nature of a carpet or carpet tile or the like. Such a tile may have a conventional backing (which should be thermally resistant and may, for example, be of a vinyl material). The major face, which preferably comprises tufts or pile, is preferably of white or a pale neutral colour (such as cream or beige). The major face of the textile article typically comprises a textile fibre such as a polyamide, polyester or a blend thereof.

The predetermined shape is preferably rectilinear (square or rectangular). The edge templates preferably comprise longitudinally extending spacers arranged to abut the edges of the predetermined shape. Such spacers are preferably arranged to abut at least two of the edges of the area of predetermined shape, more preferably two edges which are substantially perpendicular to one another. The spacers may be arranged to abut two, three or four edges of such a rectilinear shape.

The edge templates are preferably themselves aligned in the correct orientation on the sublimation transfer carrier sheet by means of registration marks or lines on the sheet. Such marks or lines may, in some embodiments, be pre-printed on the carrier sheet.

The sublimation transfer carrier sheet is typically of a thermal resistant backing, for example, of paper or the like. The carrier sheet typically includes a marginal area free of the mirror image, but including the edge templates. In other words, if there are edge templates provided for two edges of the predetermined shape, then there are two corresponding marginal areas adjacent the mirror image.

It is particularly preferred that a plurality of articles are successively or simultaneously subjected to sublimation transfer in the method according to the invention, each article comprising an area of predetermined shape with associated edge templates. By this means, a series of the sublimation transfer carrier sheets may be applied to successive ones of the predetermined shapes, such that a complex pictorial image can be built up on successive articles to be located adjacent one another.

The respective templates for each article help to ensure that the printed images on successively printed ones of the predetermined shapes are in a register with one another.

The mirror image on the sublimation transfer carrier sheet may be monochrome or multicolour; it is preferably a full colour image such that a corresponding full colour print can be produced on the face of the textile article.

A preferred embodiment of the invention will now be described with reference to the accompanying drawings.

DETAILED DESCRIPTION OF THE PREFERRED EMBODIMENT

Figure 1:
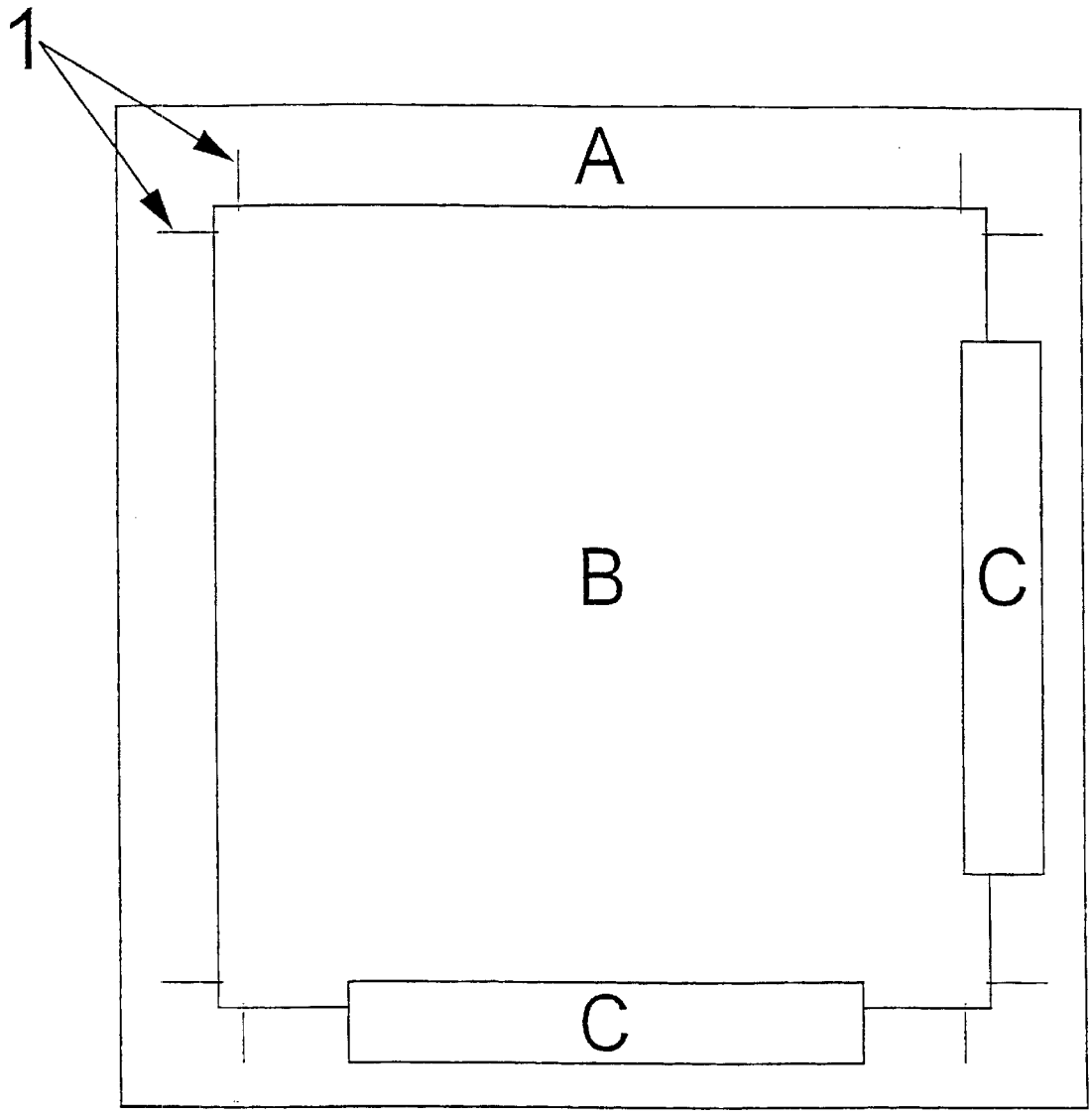
FIGS. 1 and 2 show in schematic manner and by way of illustration only the sequence of operation in the method according to the invention.

Referring in more detail to FIG. 1, this shows a paper carrier sheet A having thereon printed registration lines 1. A central area of carrier sheet A has a mirror image thereon; the mirror image is transferrable by sublimation. Printed registration lines define a marginal area (including a "bleed area" of the mirror image). The lines define the positions of edge templates or registration guides C, which have elongate edges at right angles to one another.

Figure 2:
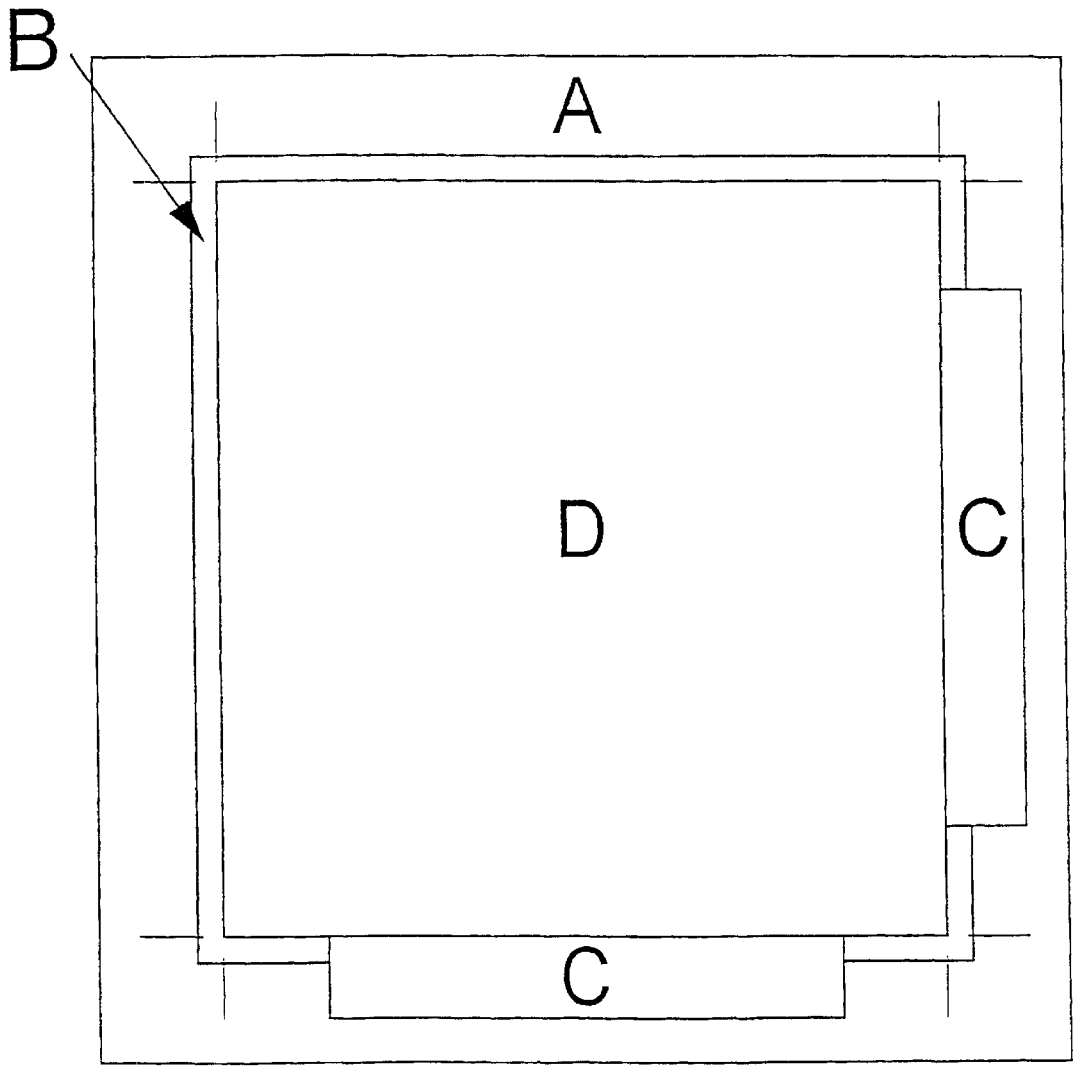

In use, and as shown in more detail in FIG. 2, the registration guides are arranged to abut mutually perpendicular edges of a carpet tile D.

Once the carrier sheet has been located in the position shown in FIG. 2, sublimation transfer is allowed to take place from carrier A; the latter is then removed so as to result in a sublimation transfer image on carpet tile D.

Different images can be arranged on various paper carriers a in order to provide a continuous image on a plurality of carpet tiles D.

What is claimed is:

1. A method of producing a registrable visible image on two or more substantially flat articles, which method comprises:

(a) providing said substantially flat articles each having at least one major face of substantially uniform pale color and of predetermined shape, said shape having at least two edges each of which edges defines a respective step when the article is laid on a support surface;

(b) providing a sublimation transfer carrier sheet for a first one of said articles having a predetermined mirror image on an area of said carrier sheet, such that said mirror image is adapted to substantially cover said predetermined shape of said one article;

(c) providing edge templates adjacent said area, each of said edge templates being arranged to abut a corresponding edge of said predetermined shape;

(d) placing said one article and its sublimation transfer carrier sheet on said support surface and arranging said area of said carrier sheet in contact with said major face such that said mirror image substantially covers said predetermined shape with each of said two edges abutting a respective one of said edge templates;

(e) allowing sublimation transfer of said image from said carrier sheet to said face;

(f) removing said carrier sheet and said edge templates from said face so as to leave a predetermined visible image on said face within said shape; and (g) carrying out steps (b) to (f) at least one further time on at least a further one of said articles which can be arranged in register with the images extending continuously across a plurality of said articles.

2. A method according to claim 1, wherein the shapes defined by the major face are space-filling shapes.

3. A method according to claim 2, wherein the shapes are tessellating.

4. A method according to claim 1, wherein each article has a thermally resistant backing.

5. A method according to claim 1, wherein each article is a textile.

6. A method according to claim 1, wherein each article is of the nature of a carpet or carpet tile.

7. A method according to claim 1, wherein at least the first one of the articles has a major face which comprises tufts or pile.

8. A method according to claim 1, wherein at least the first one of the articles has a major face which is of a white or a pale neutral color.

9. A method according to claim 1, wherein at least the first one of the articles has a major face which comprises polyamide, polyester or a blend thereof.

10. A method according to claim 1, wherein the predetermined shape is rectilinear.

11. A method according to claim 1, wherein the edge templates comprise longitudinally extending spacers arranged to abut the edges of the predetermined shape.

12. A method according to claim 11, wherein the spacers are arranged to abut at least two of the edges of the area of predetermined shape.

13. A method according to claim 12, wherein the at least two edges being abutted are substantially perpendicular to one another.

14. A method according to claim 1, wherein the edge templates are aligned in an orientation on the sublimation transfer carrier sheet by means of registration marks or lines on the sheet.

15. A method according to claim 14, wherein the marks or lines are pre-printed on the carrier sheet.

16. A method according to claim 1, wherein the sublimation transfer carrier sheet has a thermal resistant backing.

17. A method according to claim 1, wherein the carrier sheet includes a marginal area free of the mirror image but including the edge templates.

18. A method according to claim 1, wherein the mirror image is a multicolor, full color image.

* * * * *